United States Patent [19]

Cooke

[11] 4,089,710

[45] May 16, 1978

[54] PHOSPHATING METHOD WITH CONTROL IN RESPONSE TO CONDUCTIVITY CHANGE

[75] Inventor: Brian Alfred Cooke, Knotty Green, England

[73] Assignee: Imperial Chemical Industries Limited, London, England

[21] Appl. No.: 678,439

[22] Filed: Apr. 19, 1976

[30] Foreign Application Priority Data

Apr. 23, 1975 United Kingdom ..... 16799/75

[51] Int. Cl.[2] ..... C23F 7/10

[52] U.S. Cl. ..... 148/6.15 Z; 148/6.15 R

[58] Field of Search ..... 148/6.15 Z, 6.15 R

[56] References Cited

U.S. PATENT DOCUMENTS

| | | | |
|---|---|---|---|
| 3,312,189 | 4/1967 | McVey | 118/7 |
| 3,338,755 | 8/1967 | Jenkins et al. | 148/6.15 Z |
| 3,369,928 | 2/1968 | Arlow | 148/6.15 Z |
| 3,525,651 | 8/1970 | Smith et al. | 148/6.15 Z |
| 3,607,453 | 9/1971 | Engesser et al. | 148/6.15 Z |
| 3,758,349 | 9/1973 | Engesser | 148/6.15 Z |
| 3,758,349 | 9/1973 | Engesser | 148/6.15 Z |

FOREIGN PATENT DOCUMENTS

| | | | |
|---|---|---|---|
| 606,382 | 8/1948 | United Kingdom | 148/6.15 R |

*Primary Examiner*—Ralph S. Kendall

*Attorney, Agent, or Firm*—Cushman, Darby & Cushman

[57] ABSTRACT

A method of controlling a continuous process of phosphating metal surfaces in which an acidic zinc phosphate solution is brought to the steady state and there maintained in response to conductivity change, as phosphating proceeds, by addition of replenishments (a) acidic zinc phosphate and (b) alkali metal ion in a definite ratio of addition rates.

6 Claims, No Drawings

PHOSPHATING METHOD WITH CONTROL IN RESPONSE TO CONDUCTIVITY CHANGE

This invention relates to a method of applying a zinc phosphate coating to a metal surface.

Phosphate coatings are commonly applied to metal surfaces, for example surfaces comprising iron, zinc or aluminium, by reaction of the metal surface with a solution which comprises an acidic metal phosphate. Oxidants which accelerate this reaction and other suitable additives may also be present as constituents of a working phosphating solution. As the coating reaction proceeds, the working solution becomes depleted in certain of its constituents and the rate of depletion of these constituents may well be different in each case. Some constituents, for example those which act in the manner of a catalyst, may be depleted due to drag-out on the work pieces only or due to leakage, whereas those constituents which react with the metal surface will be depleted in an amount which will usually correspond with the area of metal which is treated.

In order to maintain or to achieve that optimum concentration of essential constituents which is necessary in a working solution for achieving a consistent and satisfactory phosphate coating it is necessary to add to the solution one or more replenishment concentrates which make good the depletion of each constituent. The chemical composition and the rate of addition of the replenishment concentrate or concentrates must take into account a number of factors such as (a) the loss of constituents by leakage, drag-out or evaporation from the coating plant, (b) the rate of consumption of individual ingredients by the coating reaction and (c) the optimum concentration of constituents which is desirable for satisfactory operation of the coating process, bearing in mind the effect of other variables such as the prevailing temperature.

A further factor to be taken into account in the case of solutions comprising zinc phosphate is that, in order to ensure that it has satisfactory storage stability, a replenishment concentrate comprising zinc phosphate must usually contain a higher ratio of free acid to total acid than can be tolerated in the working solution for satisfactory operation of the process. (The free acid and the total acid content of a composition or concentrate are determined by titration of an appropriate sample against alkali using methyl orange and phenolphthalein indicators respectively). Thus it is necessary to compensate in the overall replenishment of the working solution for this addition of excess acid with the zinc phosphate and it is established practice to make appropriate addition to the working solution of an alkaline material (sometimes termed "a toner") in order to maintain a level of acidity desired for the process.

The effect of making replenishment additions such as those mentioned above, as well as the effect of the generation of by-products in the reaction, is generally that the total composition of the phosphating solution under settled working conditions is significantly different from the total composition of the solution at the outset of the process, i.e. as first prepared and before coating takes place.

It has been recognised previously that some form of continuous control of the concentration of the important constituents of the working solution is essential for satisfactory operation. Automatic control has been practised in certain cases where the working solution does not comprise zinc phosphate but with zinc phosphate-containing solutions there have been problems associated with the control of acidity and with the general operation of the process which have dictated the use of manual control procedures.

Automatic or semi-automatic control procedures which have been proposed for phosphating processes include a step (a) such as the measurement of electrolytic conductivity, the measurement of the chemical potential of one or more ions in solution or the direct measurement by titration (manual or automatic) of the concentration of certain specific ions; and a step (b), the subsequent addition of a suitable replenishment in response to any of the these measurements in order to maintain an optimum working composition. The measurement of conductivity can be achieved with simple equipment and it would be attractive as a means of controlling the replenishment of working solutions comprising zinc phosphate were it not for the fact that the changes in composition due to the necessary addition of alkali cause variations in conductivity which are not directly related to the useage of essential ingredients. Thus there would be at least an initial period, at the outset of the process, when the composition of the working solution could not be controlled by conductivity measurement and the coating applied to a metal surface would be unsatisfactory or the process economics adverse.

We have found however that the measurement of conductivity of acidic zinc phosphate solutions can be used to advantage under certain specific conditions.

Thus, in a method of applying a zinc phosphate coating to a continuous metal surface or to a series of metal surfaces of the type wherein:

(1) the metal surface is treated with an acidic phosphating solution which comprises zinc, phosphate and alkali metal ions, (2) the acidic solution is replenished as coating proceeds by appropriate additions of a material (a) comprising zinc and phosphate ions and of another material (b) comprising alkali metal ions, (b) having an alkaline reaction relative to (a), and (3) the composition of the acidic solution when in the steady state is at a desired optimum which can be maintained substantially constant as coating proceeds by additions of materials (a) and (b) in a definite ratio of addition rates, the composition of the acidic phosphating solution is brought to that composition which is characteristic of the steady state at the desired optimum, a continuous metal surface or a series of metal surfaces is passed through the acidic phosphating solution, and thereafter additions are made to the acidic phosphating solution of materials (a) and (b) so as to maintain constant its electrolytic conductivity at a given temperature, the addition rates of (a) and (b) made in response to any change in conductivity being in a definite ratio as defined in (3).

We provide, therefore, an improved and consistent method of controlling the composition of an acidic zinc phosphate solution when used in a continuous phosphating process. We also provide a continuous process of coating metal surfaces, which can be automatically maintained from the outset to provide coatings of consistent quality given a knowledge of the optimum concentration of essential ingredients when the coating solution is in the steady state.

By the term "steady state" of a phosphating solution in a given process we mean that the composition of the solution does not vary systematically with time of operation, the criterion of systematic variation being established over periods of the order of several hours. Those skilled in the art will recognize the existence of the steady state of a coating solution in a given type of continuous phosphating process since it exists when a coating of a desired and consistent quality is being continuously applied to metal surfaces (or to a continuous metal surface) which are being passed through the coating solution and when the addition of replenishment ingredients is in balance with the loss of ingredients from the coating solution, e.g. as ingredients are consumed by the chemical reactions taking place, by leakage and by carry-over with the coated surface etc., such that the concentration of the essential ingredients remains substantially constant.

This invention is applicable to a phosphating process in which the phosphating solution has reached the steady state and in which the steady state can be maintained by addition of essential replenishment ingredients in a definite ratio of addition rates. The maintenance of a phosphating solution at the steady state in this way is well established in the art where the solution is conventionally monitored by analysis for specific ingredients, replenishment ingredients being added subsequently in a definite ratio. It is our discovery that the conductivity of the phosphating solution can be employed to sense the need for replenishment addition provided that the solution is in the steady state from the outset.

The composition of the acidic phosphating solution at the steady state can be determined readily by analysis of phosphating solutions which contain ingredients desired in the process to be used and which by conventional procedures have been adjusted to coat metal surfaces in a desired satisfactory and consistent manner. In using these conventional procedures there is likely to have been, at least initially, some inconsistency in coating and wasteage which can be eliminated by use of the present process.

The composition of the acidic phosphating solution at the steady state may also be determined, at least partly, by theoretical means taking into consideration the various chemicl reactions involved, the replenishment additions, and the total losses which include both liquid losses due to entrainment on the coated metal surface and losses due to any sludge precipitated in the solution, and any other factor.

Whilst we refer to a process in which replenishment is effected by additions of (a) and (b) in a definite ratio of addition rates it should be understood that in certain circumstances, as coating proceeds, it may be desirable to vary this definite ratio.

Whereas in its simplest form the phosphating process to which our invention applies comprises the replenishment of the phosphating solution with materials (a) and (b) as above defined it is envisaged that other materials additional to (a) and (b), for example (c), (d) etc. may also be added where necessary. In such a case all of these additions will be made in a definite ratio of addition rates to maintain the steady state. Whilst these materials (a), (b), (c) etc. are generally added to the phosphating solution individually it may be convenient to combine one or more of the materials before addition.

The materials (a) and (b) and any further materials with which the phosphating solution is replenished will together comprise the total ingredients which are necessary to maintain the solution in the steady state as coating proceeds. The minimum ingredients comprise zinc, phosphate and alkalimetal ions but in general most phosphating processes will require replenishment with further ingredients, for example a depolarising oxidant. These further ingredients may be included in materials (a) or (b) or in further replenishment materials, depending for example upon their relative reactivity and their solubility in concentrated solutions.

In a preferred process according to the invention, the acidic phosphating solution comprises as essential ingredients zinc, phosphate, chlorate and optionally nitrate ions, and in such a case, for example, material (a) comprises zinc, phosphate, nitrate and chlorate ions and material (b) comprises sodium ions. However, other suitable depolarising oxidants may be used in the process, for example, nitrite, perchlorate, persulphate, perborate and hydrogen peroxide. Another suitable alkali metal ion for use in material (b) is potassium ion.

The process may be applied to ferrous or non-ferrous metal.

The present process is applicable to spray application or dip application of zinc phosphate coatings. The process is particularly useful in spray application.

The invention is illustrated by the following Examples in which parts and percentages are by weight.

EXAMPLE 1

This Example describes the coating of steel panels with zinc phosphate according to the method of the present invention, using a phosphating solution which comprised zinc, phosphate, chlorate, nitrate and sodium ions. The optimum composition of the solution at the steady state was determined by analysis of prior phosphating baths of this type which were known to be in the steady state and which give satisfactory coatings at that steady state.

Replenishment materials (a) and (b) according to the invention were as follows:

| (a) | Zinc/Phosphate/Nitrate/Chlorate | |
|---|---|---|
| | Zinc Oxide | 122 parts |
| | 59% nitric acid | 102 parts |
| | 81% phosphoric acid | 338 parts |
| | Sodium Chlorate | 79 parts |

were dissolved in water to give a total weight of 1,000 parts.

| (b) | Sodium/Oxidant ("Toner") | |
|---|---|---|
| | Sodium Hydroxide | 84 parts |
| | Sodium Nitrite | 25 parts |

were dissolved in water to give a total weight of 1,000 parts.

An initial acidic phosphating solution was prepared by mixing 102 parts of the solution of replenishement material (a) with 50 parts of an intimately mixed solid starter powder (consisting of 145 parts sodium dihydrogen phosphate, 67 parts sodium chlorate, 213 parts sodium nitrate and 76 parts sodium chloride) the mixture being dissolved in further water to a total weight of 5,000 parts. This initial solution (also containing a small proportion of sodium carbonate) had a total acid pointage of 10.5 and a free acid pointage of 0.5 (Pointage = mls of $N_{10}$ sodium hydroxide required to titrate a 10 ml sample of the solution using methyl orange as indicator for free acid and phenolphthalein as indicator for total acid). The conductivity of the solution was 2.32 × $10^{-2}$ ohms$^{-1}$ cm$^{-1}$ at 50° C.

Rolled mild steel panels measuring 30.5 cm × 22.9 cm × 0.9 mm thick were treated by spray application with the above solution at a temperature of 50° C and at a rate of 4 panels/hour. The rate of metal treatment was thus 0.112 sq.m/liter of bath/hour and at this rate of treatment after 12 hours total running there had been a complete turnover of the zinc content of the bath.

Coating was continued for a total time of 24 hours but in four separate periods of 6 hours each.

The replenishment of the phosphating solution was effected by simultaneous additions of the above solutions (a) and (b) in a constant ratio of feed rates, 0.43g of (b) being added for every 1g of (a), in response, to changes in the electrical conductivity of the phosphating solution. The electrical conductivity was measured by conventional means there being provided means for preventing insulation of the conductivity sensor by precipitated materials. 50 part by volume portions of the bath were rejected at ½ hour intervals and the original volume restored in order to simulate the carry-over in an operational plant. No additions were made to the bath other than those mentioned. At no time did the concentration of ferrous ion in the phosphating solution exceed 56 ppm and the concentration of nitrite ion did not exceed 0.3 millimoles/liter.

A high standard of coating was maintained throughout the experiment, the coating weight being approximately 1.9g/sq. m. The final free acid pointage was 0.5, the final total acid pointage 10.4 and the conductivity 2.23 × $10^{-2}$ohm$^{-1}$cm$^{-1}$. The analysis of the bath remained substantially as it was at the beginning of the experiment when it was as follows: 2g/l of zinc as Zn; 7.7g/l of phosphate as $PO_4$; 2.3g/l of chlorate as $C10_3$, 4.3g/l of nitrate as $NO_3$3.2g/l of sodium as Na; and 0.93g/l of chloride as Cl. The phosphated panels were subsequently satisfactorily painted by electrodeposition or by spraying and the finished panels were consistent in appearance and corrosion resistance.

EXAMPLE 2

This Example describes the coating of steel articles on a plant scale by the spray application of a working solution which comprised zinc, phosphate, chlorate, nitrate and sodium ions.

A phosphating tank of 5,400 liters capacity was charged with an initial ("start-up") phosphating solution prepared by mixing 102 parts of a replenishment concentrate (a) which was compounded from the ingredients:

| | |
|---|---|
| Zinc oxide | 122 parts |
| 59% nitric acid | 102 parts |
| 81% phosphoric acid | 338 parts |
| Sodium chlorate | 79 parts |

these ingredients being dissolved in water to give a total weight of 1,000 parts, and 50 parts of an intimately mixed solid starter powder consisting of:

| | |
|---|---|
| Sodium dihydrogen phosphate | 145 parts |
| Sodium chlorate | 67 parts |
| Sodium nitrate | 213 parts |
| Sodium chloride | 76 parts |

the mixture being dissolved in further water to a total weight of 5,000 parts. The initial solution had a total acid pointage of 10.5 and a free acid pointage of 0.5.

Steel articles were sprayed with the solution prepared as described above at a temperature of 110°-115° F to give a coating weight on the steel of 1.3g/square meter. The replenishment concentrate (a) described above and a toner concentrate (a) described above and a toner concentrate (b), which comprised:

| | |
|---|---|
| Sodium hydroxide | 44 parts |
| Sodium nitrite | 44 parts |

(these ingredients being dissolved in water to give a total weight of 1,000 parts,) were fed concurrently so that they were added to the working solution in equal volumes. Additions were initiated by an automatic controller so as to hold the conductivity of the solution constant. The chemical analysis of the solution was maintained substantially constant at: Zinc as Zn, 2.00g/l; phosphate as $PO_4$, 7.04g/l; chlorate as $C10_3$, 2.10g/l and nitrate as $NO_3$, 3.95g/l. The concentration of nitrate ion in the solution under these conditions was substantially zero and that of ferrous ion was less than 20 ppm.

The process was continued for 12 hours a day over 20 working days and a total of 1.5 × $10^5$ square meters of steel was coated. It was found by scanning electron microscopy that the deposited phosphate coating completely covered the steel surface and was of fine grain. A coating of paint, applied subsequently electrodeposition, gave excellent performance when subjected to accelerated tests for corrosion resistance and mechanical properties.

We claim:

1. In a method of applying a zinc phosphate coating to a continuous metal surface or to a series of metal surfaces wherein (1) a metal surface is treated with an acidic phosphating solution which comprises zinc, phosphate and alkali metal ions, (2) the acidic phosphating solution is replenished as coating proceeds by additions of an acidic material (a) comprising zinc phosphate ions, and of an alkaline material (b) comprising alkali metal ions, and (3) the composition of the acidic phosphating solution when in the steady state is such that a consistent and satisfactory coating is produced on the metal surface, and can be maintained substantially constant, as coating proceeds, by additions of materials (a) and (b) in a definite ratio of addition rates, the improvement which consists in commencing to treat a metal surface or metal surfaces in a phosphating solution which is already in said steady state, and thereafter making additions to the acidic phophating solution of materials (a) and (b) so as to maintain constant its electrolytic conductivity at a given temperature, the addition rates of (a) and (b) made in response to any change in conductivity being in the same said definite ratio.

2. A method according to claim 1 wherein the desired optimum composition of the acidic phosphating solution when in the steady state is determined by the analysis of a working acidic phosphating solution which provides a desired phosphate coating by a conventional procedure.

3. A method according to claim 1 wherein the acidic solution is replenished as coating proceeds by materials additional to materials (a) and (b).

4. A method according to claim 1 wherein the acidic phosphating solution also comprises a depolarising oxidant.

5. A method according to claim 1 wherein the acidic phosphating solution comprises zinc, phosphate, alkali metal, chlorate and optionally nitrate ions.

6. A method according to claim 1 wherein the metal surface comprises a ferrous metal.

* * * * *